US008435041B2

(12) United States Patent
Holland

(10) Patent No.: US 8,435,041 B2
(45) Date of Patent: May 7, 2013

(54) MAGNETIC CLOSURE FOR ELECTRICAL SOCKET

(75) Inventor: Gregory J. Holland, Wolcott, CT (US)

(73) Assignee: Casco Products Corporation, Bridgeport, CT (US)

( * ) Notice: Subject to any disclaimer, the term of this patent is extended or adjusted under 35 U.S.C. 154(b) by 0 days.

(21) Appl. No.: 13/176,167

(22) Filed: Jul. 5, 2011

(65) Prior Publication Data

US 2012/0295457 A1 Nov. 22, 2012

Related U.S. Application Data

(63) Continuation-in-part of application No. 13/110,264, filed on May 18, 2011, now abandoned.

(51) Int. Cl.
*H01R 13/62* (2006.01)

(52) U.S. Cl.
USPC ..... 439/38; 439/142

(58) Field of Classification Search ..... 439/38, 439/142, 144
See application file for complete search history.

(56) References Cited

U.S. PATENT DOCUMENTS

| | | | | |
|---|---|---|---|---|
| 3,659,248 | A | 4/1972 | Mann et al. | |
| 4,926,573 | A | 5/1990 | Hetrick | |
| 4,999,599 | A | 3/1991 | Spier | |
| 5,060,977 | A | 10/1991 | Saito | |
| 5,144,111 | A | 9/1992 | Von Gaisberg et al. | |
| 5,517,388 | A | 5/1996 | Hutchisson | |
| 6,070,591 | A | 6/2000 | Bryer | |
| 6,382,450 | B1 | 5/2002 | De Rosa et al. | |
| 6,551,142 | B2 | 4/2003 | Eisenbraun | |
| 7,071,414 | B2 | 7/2006 | Kim | |
| 7,281,814 | B2 | 10/2007 | Sheen | |
| 7,520,663 | B1 * | 4/2009 | Kolar et al. | 366/347 |
| 7,621,753 | B1 | 11/2009 | Pai | |
| 7,736,151 | B1 | 6/2010 | Yang | |
| 8,155,714 | B2 * | 4/2012 | Allard | 455/575.3 |
| 2001/0051460 | A1 | 12/2001 | Ota et al. | |
| 2002/0022496 | A1 * | 2/2002 | Park | 455/550 |
| 2004/0099702 | A1 * | 5/2004 | Conner | 224/163 |
| 2005/0014408 | A1 | 1/2005 | Swiatek et al. | |
| 2005/0150513 | A1 * | 7/2005 | Taylor | 132/316 |
| 2005/0181675 | A1 | 8/2005 | Kim | |
| 2005/0246982 | A1 | 11/2005 | MacMillan et al. | |
| 2006/0288533 | A1 * | 12/2006 | Lee | 16/330 |
| 2007/0234757 | A1 * | 10/2007 | Sherman | 63/18 |
| 2008/0295283 | A1 | 12/2008 | Tice | |
| 2009/0022441 | A1 | 1/2009 | Berthier et al. | |

(Continued)

OTHER PUBLICATIONS

International Search Report and Written Opinion dated Jun. 14, 2012 in corresponding International Application No. PCT/US2012/025232.

*Primary Examiner* — Gary F. Paumen
(74) *Attorney, Agent, or Firm* — Ostrolenk Faber LLP

(57) ABSTRACT

An electrical socket comprising an electrical receptacle, a cover for the receptacle, a hinge coupling the cover to the receptacle so that the cover can pivot toward and away from an opening in the receptacle to allow insertion of an electrical plug into the receptacle. A paired combination is provided comprising a magnet and a magnet attractive region on ones of the cover and receptacle causing the cover to be attracted to the receptacle when the cover gets to a predetermined distance from the receptacle thereby causing the cover to be closed on the receptacle by magnetic attraction when the plug is not inserted.

20 Claims, 7 Drawing Sheets

U.S. PATENT DOCUMENTS

2011/0003486 A1 1/2011 Chien
2011/0050212 A1 3/2011 Henning
2011/0273821 A1* 11/2011 Shen ..... 361/679.01
2011/0278966 A1 11/2011 Osborne et al.
2011/0308973 A1* 12/2011 Patenaude ..... 206/63.5
2012/0072167 A1* 3/2012 Cretella et al. ..... 702/150

* cited by examiner

MAGNETIC CLOSURE FOR ELECTRICAL SOCKET

CROSS REFERENCE TO RELATED APPLICATION

This application is a continuation-in part of U.S. Ser. No. 13/110,264 filed May 18, 2011 entitled MAGNETIC CLOSURE FOR ELECTRICAL SOCKET, priority of which is claimed under 35 U.S.C. §120.

BACKGROUND OF THE INVENTION

The present invention is related to electrical sockets, for example, electrical power sockets, and in particular, to electrical sockets having hinged covers. More particularly, the invention is related to an electrical socket having a hinged cover that is retained in a closed position by magnetic force, and particularly for use as an electrical power socket in automotive vehicles, for example, for supplying vehicle system electrical power to various portable plug-in electrical or electronic devices.

Although hinged covers for electrical sockets have been used in automotive applications, the use of springs to hold the cover in the closed position or mechanical detent type latches to hold the cover closed are the current industry methods. Friction type hinges are used if no spring is required. This latter design allows the cover to remain open at various positions.

It is also known to use magnetic closures for entirely different applications, for example, as closure elements for purses and cell phone holsters.

It is desirable to provide an electrical power socket that is simpler than the prior art designs and that has fewer components, like springs, latches and detents, subject to breakage and wear. In this design, the magnet becomes an integral part of the cover simplifying the structure and eliminating the concerns of retention, becoming loose and rattling. It is furthermore desirable to provide a covered electrical power socket that allows the cover to remain open at various positions without the risk of broken or worn latches or springs and without the snapping closed effect of a spring loaded cover.

SUMMARY OF THE INVENTION

The invention provides a closure for an electrical socket that has a magnet and hinge to allow the cover to remain open at various positions without the risk of broken or worn latches and springs and which eliminates the snapping closed effect of a spring. Preferably, the hinge is a friction hinge.

The use of magnetic attraction to retain the cover closed on the socket increases durability by eliminating broken or worn latches or springs. The magnetic attraction also provides more desirable opening and closing forces than either springs or latches. The closure according to the invention still provides an audible click sound when the cover is moved to the closed position.

In prior art latch designs based on mechanical detents, the closing force is positive. This means there is an effort required to overcome the peak force in order to fully close the cover. In contrast, the magnetic force used in the present invention is an attractive type. So the closing force actually becomes negative when the cover approaches the closed position. This means no effort is required to overcome a peak force in order to fully close the cover.

Furthermore, the force profile is smooth over travel distance or angle. More importantly, however, the force is also consistent over time because there is no mechanical wear or spring fatigue over time. This also increases durability.

According to one embodiment, the invention comprises a receptacle having an opening for receiving an electrical plug of an electrical or electronic device, the receptacle having electrical connectors therein for making electrical contact with the plug; a cover for the receptacle; a hinge coupling the cover to the receptacle so that the cover can pivot toward and away from the opening in the receptacle to allow insertion of the electrical plug into the receptacle; further comprising a region on the receptacle that is adjacent to the cover when the cover is closed; and further comprising a paired combination comprising a magnet and a magnet attractive element on ones of the cover and the region on the receptacle causing the cover to be attracted to the receptacle by magnetic force when the cover gets to a predetermined distance from the receptacle, thereby causing the cover to be closed on the receptacle opening by magnetic attraction when the plug is not inserted in the receptacle.

BRIEF DESCRIPTION OF THE DRAWING(S)

The invention will be described in greater detail in the following detailed description with reference to the drawings in which.

DETAILED DESCRIPTION OF THE FIGURES

Figure 1:
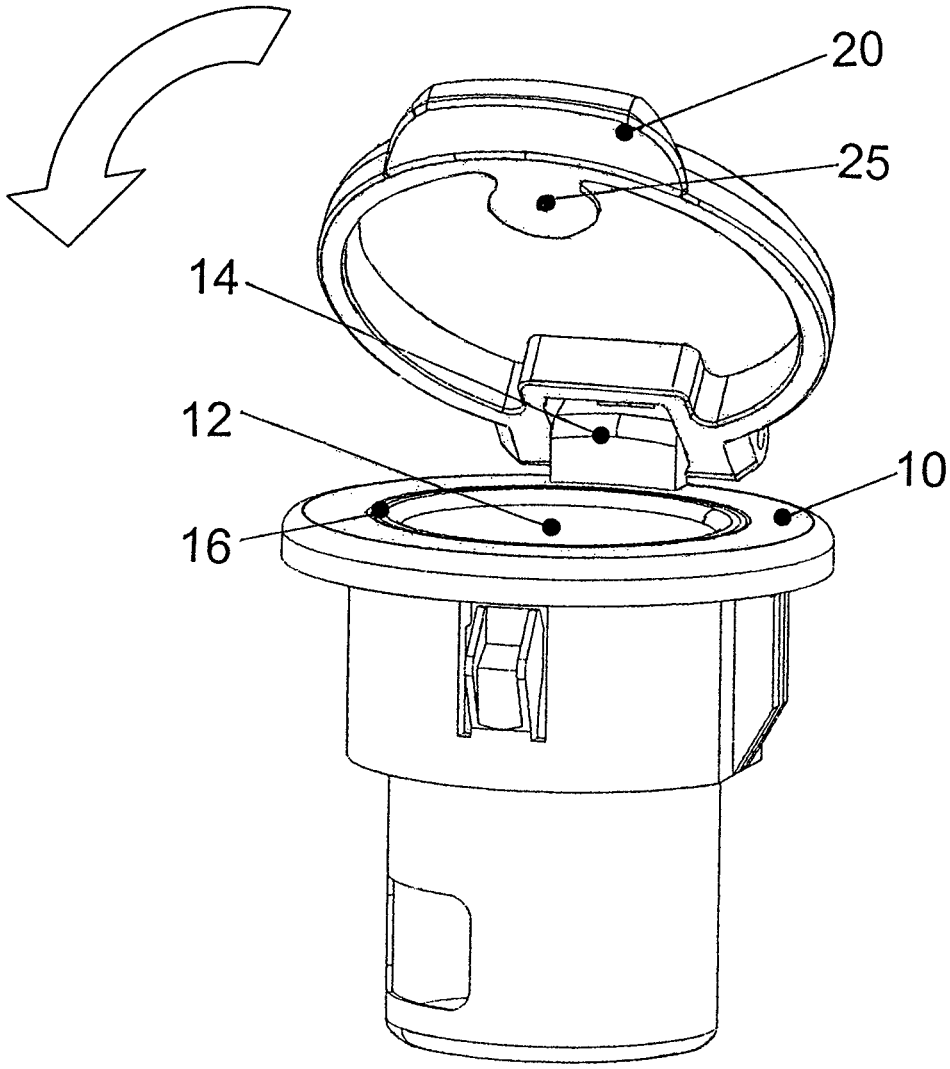
FIG. 1 is a partial perspective view of an electrical socket with the cover in a partly opened position, for example, a power outlet or cigar lighter socket for a vehicle.

With reference now to the drawings, FIG. 1 shows an electrical power socket comprising a receptacle 10 having a hinged cover 20. The receptacle 10 has suitable electrical connectors (not shown) in the opening 12 for receiving an electrical plug from an electrical or electronic device inserted into the opening 12. Such electrical connectors are known to those of skill in the art. The receptacle includes a base region 22 (FIG. 3) typically where an electrical connector (not shown) from a power source is connected to the receptacle for electrically energizing the receptacle.

Figure 2:
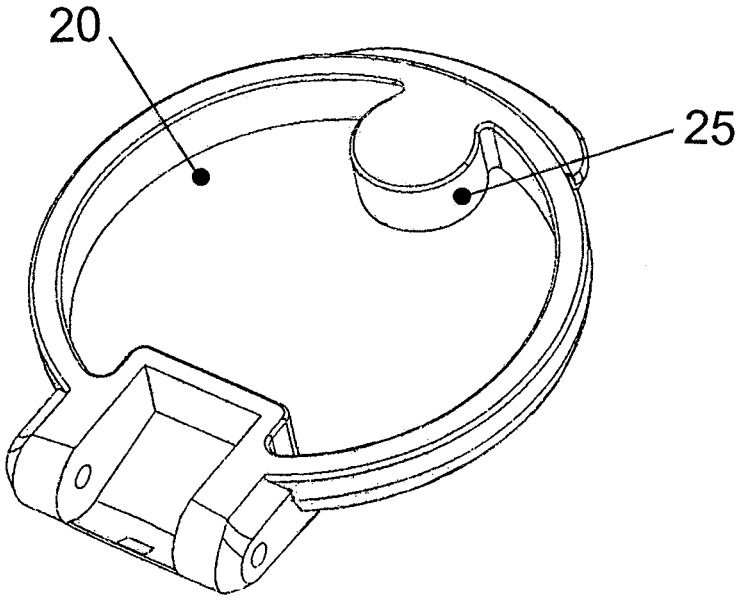
FIG. 2 shows the cover for the electrical socket according to the invention showing the magnet and part of the hinge.

The cover 20 is formed as a lid for the receptacle 10. The lid has a location provided either on the top side or the underside for receiving a magnet 25. See FIG. 2. The magnet 25 is fixed in the recess by various means, for example, with an adhesive or by a snap fit or by being molded into the cover. The cover 20 may be made of suitable plastic material or may be made of some other material, for example, metal.

According to one embodiment, the magnet is made from an unmagnetized material such as neodymium. The magnet is of the synthetic (not permanent) type. It is made by sintering or molding to the required shape and size.

The magnet may then be overmolded with a suitable plastic material to form the cover. The overmolded magnet is then magnetized, in known fashion, to attain its magnetic properties.

In this design, the magnet becomes an integral part of the cover simplifying the structure and eliminating the concerns of retention, becoming loose and rattling.

The magnet may be molded to a shape compliant to the well to optimize the magnetic force vs. size and tactile feel. The magnet may also be molded to any shape or size suitable to the assembly.

Figure 4:
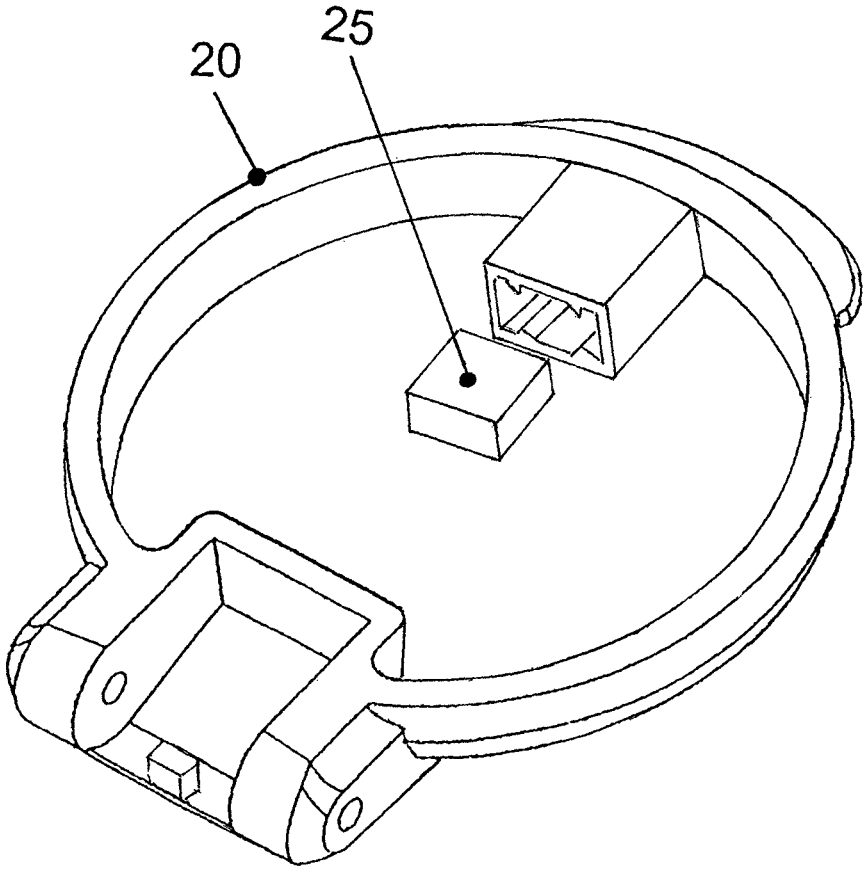
FIG. 4 shows one method of fixing the magnet in the cover.

FIG. 4 shows an embodiment wherein the magnet 25 is inserted into a molded cavity in the cover.

Figure 5:
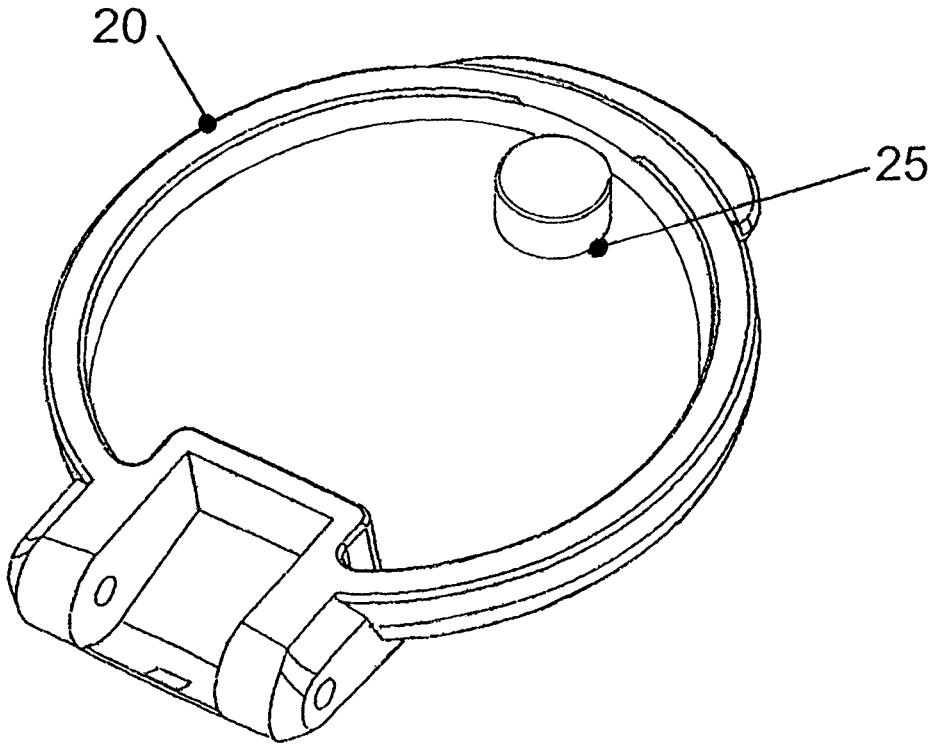
FIG. 5 shows another method of fixing the magnet in the cover.

FIG. 5 shows another embodiment where the magnet is bonded to the cover with a suitable adhesive.

Figure 6:
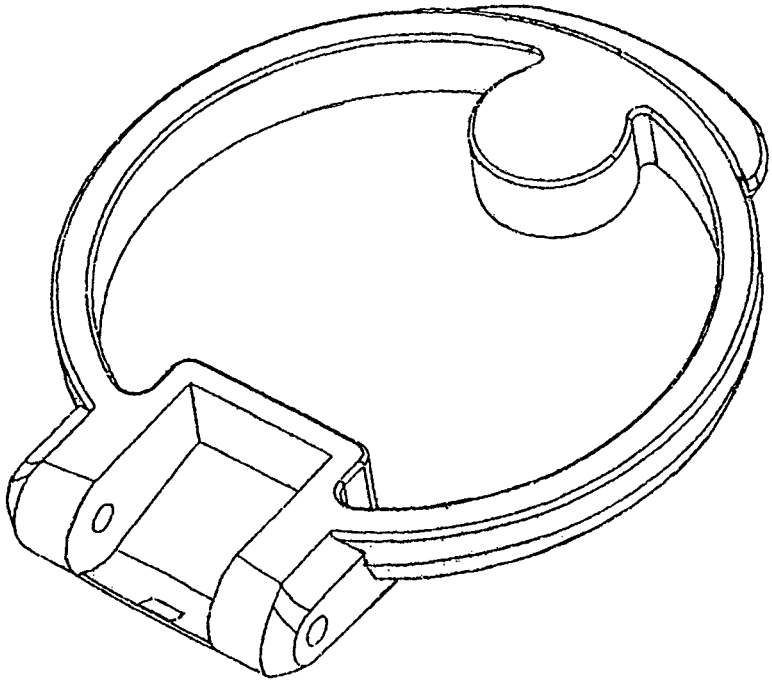
FIG. 6 shows still another method of fixing the magnet in the cover.

FIG. 6 shows the embodiment described above where the magnet is overmolded in the cover.

Although a preferred embodiment uses a sintered or molded synthetic material for the magnet which is later magnetized, a permanent type magnet or any other magnetic material can also be used.

As shown in FIG. 1, the cover 20 is hinged to the receptacle 10, preferably with a friction hinge 14. The friction hinge 14 provides enough friction to hold the cover in any desired open position, for example as shown in FIG. 1, or in a fully open position. However, when the cover is nearly closed, the magnetic attraction between the magnet 25 and a ferromagnetic surface 16 or other magnet attractive region on the receptacle 10, will cause the cover to close despite the friction provided by the friction hinge.

Figure 7:
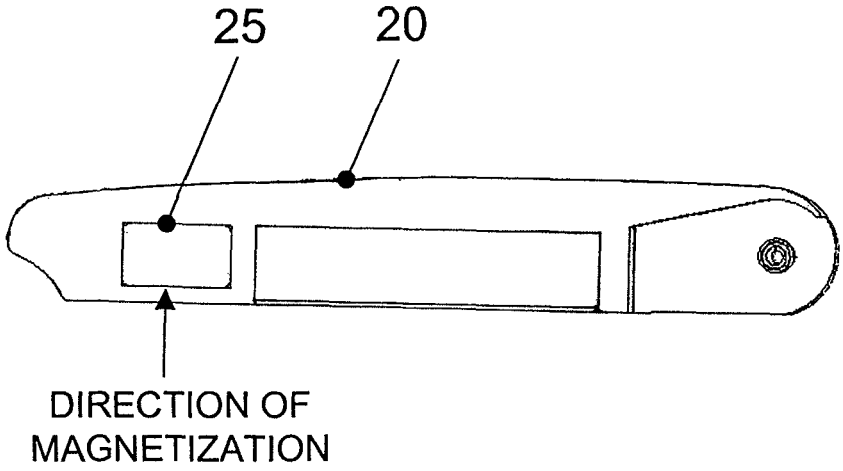
FIG. 7 shows a cross-section through the cover showing the magnet and the direction of lines of magnetization.

FIG. 7 is a cross-section through the cover. The direction of magnetization, that is, the lines of magnetic flux, preferably are in the direction through the magnet shown by the arrow.

Figure 8:
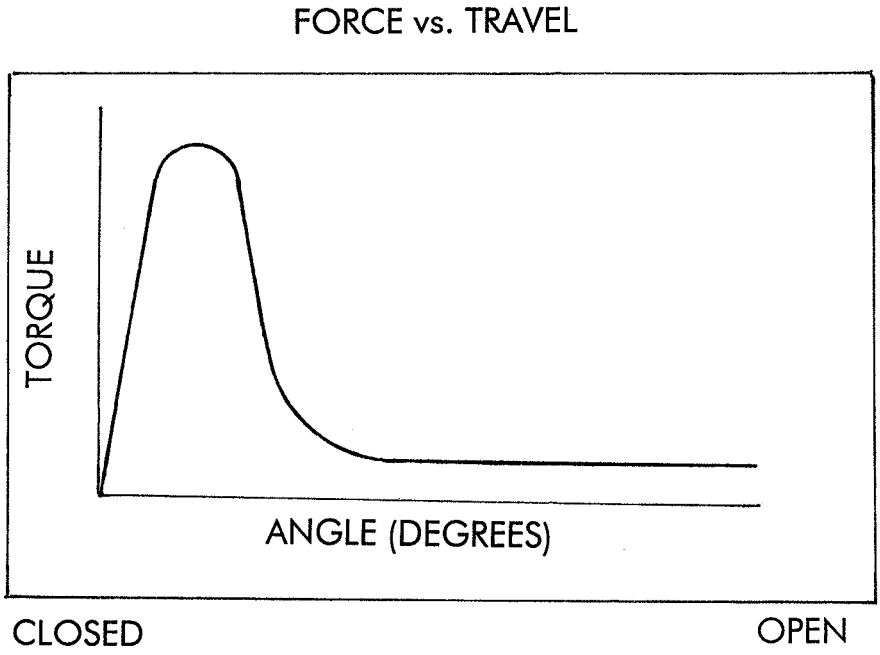
FIG. 8 shows a graph of the force applied to the cover vs. travel angle.

FIG. 8 shows a graph of the force applied vs. travel angle of the cover. As shown, the torque to open is greater when the cover is being opened from near its closed position. The torque peaks at an acute angle of opening and then rapidly falls off as the cover is opened fully.

The electrical receptacle 10 can be of any type. Shown in FIG. 1 is a power outlet of the type commonly used for electrical outlets in vehicles or a power socket that could be used as a cigar lighter receptacle.

Figure 3:
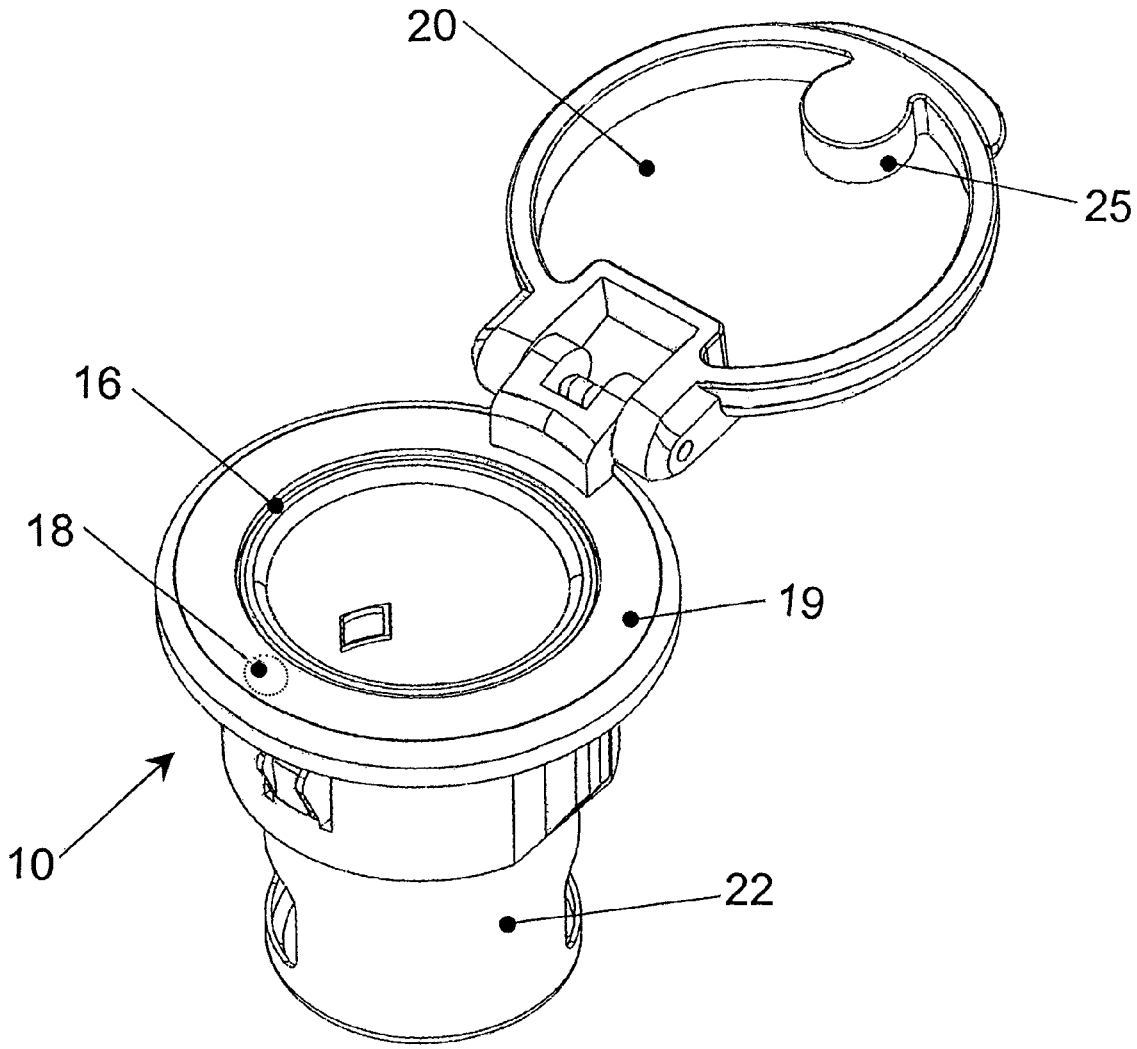
FIG. 3 shows the cover fully opened on the socket showing the magnet.

As shown in FIG. 3, the receptacle 10 includes a ring 16 which can be made of a ferromagnetic material. This ring typically forms the ground electrical connection of the receptacle and comprises the lip of a metal cylindrical well that receives the electrical plug from the electrical or electronic device.

Alternatively, a magnet attractive region which may comprise a ferromagnetic material or may itself be a magnet can be provided at 18 to attract the cover closed. The element 18, which may comprise a steel insert, may be disposed in a ring-shaped structure 19 of the receptacle 10, for example, made of plastic. If element 18 is a magnet, it is disposed so that the pole piece facing the magnet 25 in the cover is of the opposite polarity to the adjoining pole piece of the magnet in the cover.

Alternatively, the element 18 may be a magnet and the cover 20 may include a ferromagnetic object in place of the magnet 25, for example, a steel insert.

The invention provides advantages over the prior art spring loaded or friction hinge devices. It provides more desirable opening and closing forces, it eliminates broken latches and springs, provides a positive closure and an audible gentle click when closed due to the magnetic attraction without having the snapping effect of a spring loaded closure.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electrical socket comprising:

a receptacle having an opening for receiving an electrical plug of an electrical or electronic device, the receptacle having electrical connectors therein for making electrical contact with the plug;

a cover for the receptacle;

a hinge coupling the cover to the receptacle so that the cover can pivot toward and away from the opening in the receptacle to allow insertion of the electrical plug into the receptacle;

further comprising a region on the receptacle that is adjacent to the cover when the cover is closed; and further comprising a paired combination comprising a magnet and a magnet attractive element on ones of an area of the cover and the region on the receptacle causing the cover to be attracted to the receptacle by magnetic force when the cover gets to a predetermined distance from the receptacle, thereby causing the cover to be closed on the receptacle opening by magnetic attraction when the plug is not inserted in the receptacle, wherein the region on the receptacle comprises a peripheral region surrounding the opening in the receptacle and the area on the cover comprises an area on a bottom surface of the cover that faces the opening when the cover is closed.

2. The electrical socket of claim 1, wherein the magnet is provided on the cover and the receptacle comprises a magnet attractive element.

3. The electrical socket of claim 1, wherein the receptacle comprises a magnet and the cover comprises a magnet attractive element.

4. The electrical socket of claim 1, wherein the magnet attractive element comprises a magnet.

5. The electrical socket of claim 1, wherein the receptacle comprises an electrical power receptacle in a vehicle.

6. The electrical socket of claim 5, wherein the electrical receptacle comprises a cigar lighter receptacle.

7. The electrical socket of claim 1, wherein the hinge between the cover and the receptacle comprises a friction hinge.

8. The electrical socket of claim 1, wherein the cover is made of plastic and has a recess for receiving the magnet or magnet attractive element.

9. The electrical socket of claim 1, wherein the receptacle comprises a plastic ring surrounding the opening and wherein the plastic ring includes a recess for receiving a magnet or ferromagnetic insert.

10. The electrical socket of claim 9, wherein the ferromagnetic insert comprises a steel insert.

11. The electrical socket of claim 1, wherein the receptacle comprises a ferromagnetic ring for attracting the magnet that is disposed on the cover.

12. The electrical socket of claim 9, wherein the plastic ring surrounds a lip of a metal cylindrical well into which the plug is inserted.

13. The electrical socket of claim 1, wherein the cover is made of plastic and the magnet is overmolded in the plastic of the cover.

14. The electrical socket of claim 13, wherein the magnet is made of an initially unmagnetized material to the required shape and size, the magnet is then overmolded in the plastic material of the cover and the overmolded unmagnetized material is then magnetized to provide its magnetic property.

15. The electrical socket of claim 14, wherein the magnet is made by sintering or molding.

16. The electrical socket of claim 14, wherein the magnet is made of neodymium.

17. The electrical socket of claim 1, wherein the magnet is of the synthetic type.

18. The electrical socket of claim 1, wherein the magnet is a permanent magnet.

19. The electrical socket of claim 1, wherein the magnet is inserted in a cavity in the cover.

20. The electrical socket of claim 1, wherein the magnet is bonded on the cover.

* * * * *